US005793242A

United States Patent [19]

Sauer

[11] Patent Number: 5,793,242

[45] Date of Patent: Aug. 11, 1998

[54] FLOATING CAPACITOR DIFFERENTIAL INTEGRATOR

[75] Inventor: Don R. Sauer, San Jose, Calif.

[73] Assignee: National Semiconductor Corporation, Santa Clara, Calif.

[21] Appl. No.: 527,401

[22] Filed: Sep. 13, 1995

[51] Int. Cl.[6] ..... G06G 7/64

[52] U.S. Cl. ..... 327/336; 327/103; 327/344; 327/345

[58] Field of Search ..... 327/336, 344–5, 327/103

[56] References Cited

U.S. PATENT DOCUMENTS

| | | | |
|---|---|---|---|
| 4,362,999 | 12/1982 | Sauer | 329/103 |
| 4,871,985 | 10/1989 | Sempel | 331/111 |
| 5,293,514 | 3/1994 | Nakagawara | 327/336 |
| 5,489,872 | 2/1996 | Gopinathan | 327/336 |

*Primary Examiner*—Margaret Rose Wambach
*Attorney, Agent, or Firm*—Skjerven, Morrill, MacPherson, Franklin & Friel; Edward C. Kwok

[57] ABSTRACT

An integrator circuit is disclosed which overcomes problems in the art described above. In accordance with the present invention, an integrator circuit includes a differential input transconductance stage which converts an input differential signal to a differential current at first and second internal nodes. These two internal nodes are buffered from an integrating capacitor by two pass transistors, the conductance of which is automatically adjusted in response to the voltage at the two nodes. In this manner, the first and second nodes act as nearly ideal current sources. Thus, the integrating capacitor sees a nearly infinite impedance, thereby allowing the integrator circuit to achieve a large RC time constant while employing relatively small internal resistances. Further, the integrator circuit is fully differential and includes a floating capacitor having equal leakages on each of its plates. Being responsive only to differential signals, the integrator circuit thus ignores common mode leakages. The symmetrical design of the integrator circuit allows integration to take place on both sides of the capacitor. These features enable the integrator circuit to operate not only at low frequencies and at low supply voltages but also over wide variations in operating temperatures.

16 Claims, 3 Drawing Sheets

FLOATING CAPACITOR DIFFERENTIAL INTEGRATOR

CROSS REFERENCE TO RELATED APPLICATION

This application is related to commonly owned U.S. patent application entitled "DC ISOLATED INTEGRATOR" filed on Sep. 13, 1995, Ser. No. 08/527,400, now U.S. Pat. No. 5,600,283 issued on Feb. 4, 1997.

BACKGROUND

1. Field of the Invention

The present invention relates to integrators and in particular relates to integrators formed of only on-chip components.

2. Description of Related Art

FIG. 1 shows a conventional active RC integrator 10 including an op amp 11 having an output terminal coupled to its inverting terminal through a capacitor 12. The non-inverting terminal of op amp 11 is coupled to ground and the inverting terminal of op amp 11 is coupled to receive an input signal $V_{in}$ via a resistor 13. The input signal $V_{in}$ is first converted to a current by resistor 13 and then integrated by capacitor 12 to provide an output signal $V_{our}$. Such integration circuits are commonly used in a wide variety of applications and may be tuned, by manipulating the RC time constant of the feedback loop, over a broad range of frequencies.

Integrator 10 is generally applicable in continuous time filtering. However, it becomes harder and more expensive to fabricate resistor 13 and capacitor 12 large enough to achieve an RC time constant of a magnitude sufficient for low frequency applications. While it is desirable to minimize the size of capacitor 12 so as to allow for the formation of an on-chip capacitor 12, such minimizing necessarily requires maximizing the size of resistor 13. For instance, tuning integrator 10 so as to suitable for use with audio applications which requires an RC time constant on the order of 8 ms. Desiring to form capacitor 12 as an on-chip component, capacitor 12 should not, practically speaking, exceed 20 pF. Employing such a small capacitance, however, necessitates a resistance of approximately 400 MΩ in order to realize a time constant of 8 ms. Although possible to fabricate, such a large resistor would not only consume an undesirably large amount of silicon real estate but would also drive up the cost of integrator 10.

SUMMARY

An integrator circuit is disclosed which overcomes problems in the art described above. In accordance with the present invention, an integrator circuit includes a differential input transconductance stage which converts an input differential signal to a differential current at first and second internal nodes. These two internal nodes are buffered from an integrating capacitor by two pass transistors, the conductances of which are automatically adjusted in response to the respective voltages at the two nodes. In this manner, the first and second nodes act as nearly ideal current sources. Thus, the integrating capacitor sees a nearly infinite impedance, thereby allowing the integrator circuit to achieve a large RC time constant while employing relatively small internal resistances and an integrating capacitor on the order of pico-Farads.

Further, the integrator circuit is fully differential wherein the integrating capacitor is a floating capacitor having equal leakages on each of its plates. Being responsive only to differential signals, the integrator circuit thus ignores common mode leakages. The symmetrical design of the integrator circuit allows integration to take place on both sides of the capacitor. These features enable the integrator circuit to operate not only at low frequencies and at low supply voltages but also over wide variations in operating temperatures.

DETAILED DESCRIPTION

Figure 2:
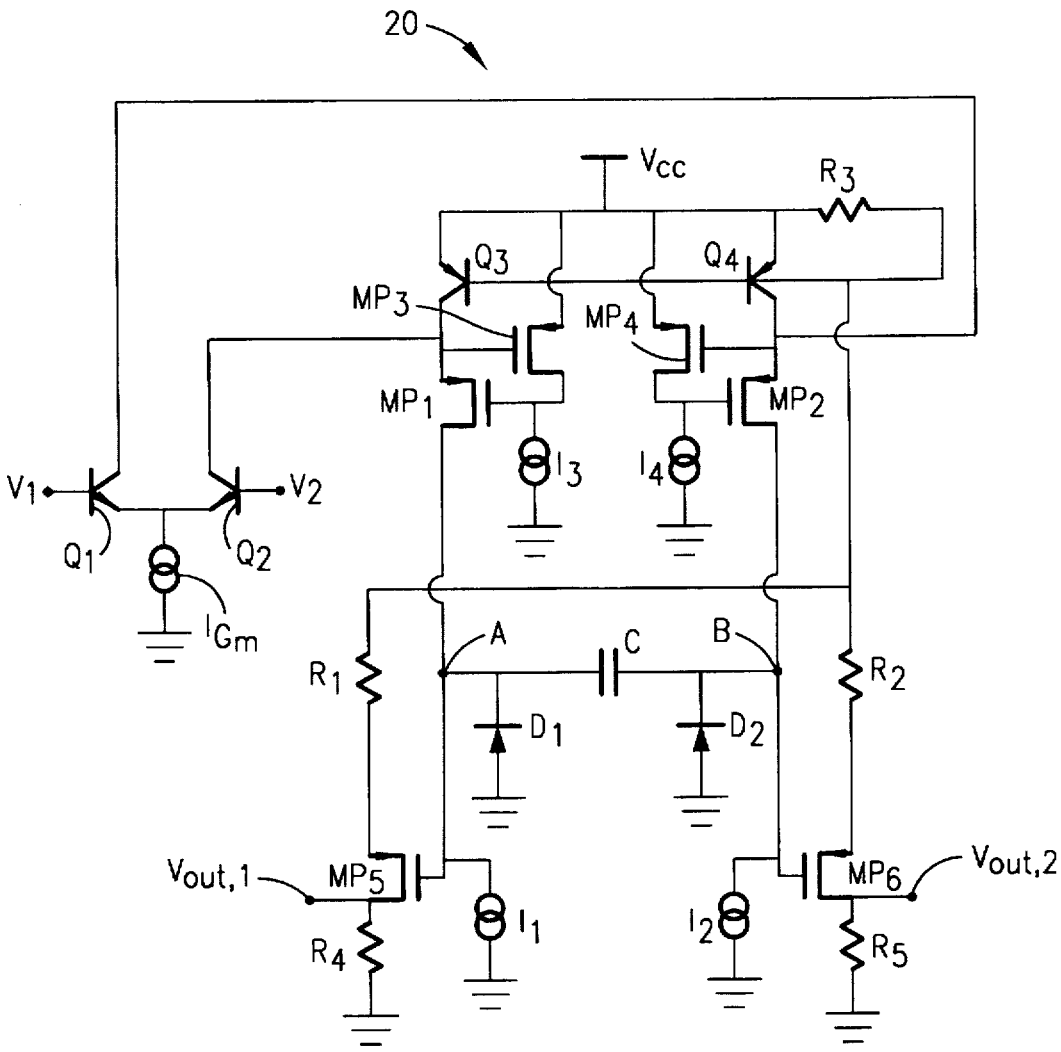
FIG. 2 shows an integrator circuit in accordance with the preferred embodiment of the present invention.

FIG. 2 shows an integrator 20 in accordance with the preferred embodiment of the present invention. Integrator 20 receives a differential input signal $V_1-V_2$ at the bases of PNP transistors Q1 and Q2, respectively. Transistors Q1 and Q2 form a differential transconductance amplifier, or $G_m$, stage and are biased by a current source $I_{Gm}$. PNP transistors Q3 and Q4 drive respective nodes A and B with a common mode current via P-channel pass transistors MP1 and MP2, respectively. Current sources $I_1$ and $I_2$ bias pass transistors $MP_1$ and $MP_2$, respectively, and are preferably conventional, high-impedance current sources formed using NPN transistors (not shown) and N-channel MOS transistors (not shown). P-channel transistors $MP_3$ and $MP_4$ are biased by respective current sources $I_3$ and $I_4$ and control the conductive states of transistors $MP_1$ and $MP_2$, respectively. P-channel transistors $MP_5$ and $MP_6$, along with resistors $R_1$ and $R_2$, form a common mode feedback loop. The drains of transistors MP5 and MP6 are commonly coupled to ground through equal value resistors $R_4$ and $R_5$, respectively. Note that in other embodiments resistors $R_4$ and $R_5$ may be replaced by other suitable equal valued components, such as diodes, which convert the currents in the respective drains of transistors MP4 and MP5 to output voltages. Resistor $R_3$ sources current to transistors MP5 and MP6 via resistors $R_1$ and $R_2$, respectively.

A integrating capacitor C is connected between nodes A and B. Capacitor C is fabricated so as to have equal parasitic leakages on each of its plates, as modeled by diodes $D_1$ and $D_2$, and is preferably formed by parallel-connecting two identical MOS capacitors.

As will be described below, integrator 20 is fully differential and, being responsive only to differential voltages and currents, thus ignores common mode voltages and currents. Further, a symmetrical design allows integrator 20 to balance increases in voltages and/or currents on one side of integrator 20 with equal decreases in voltages and/or currents on the other side of integrator 20. For instance, each mV increase in voltage at node A is balanced by a corresponding mV decrease in voltage at node B. Thus, since the common mode, or average, voltage of nodes A and B remains constant, capacitor C "floats" at a constant voltage. The particular voltage at which capacitor C floats is hereinafter referred to as the capacitor common mode voltage, or $V_{C,cm}$.

The operation of integrator 20 is as follows. Assuming that input voltages $V_1$ and $V_2$ are equal, transistors Q1 and Q2 will sink equal portions of the respective collector currents of transistors Q3 and Q4. Since transistors Q3 and Q4 conduct equal currents, pass transistors MP1 and MP2 will provide equal currents to nodes A and B, respectively. Thus, recalling that currents $I_1$, and $I_2$ are equal, there is no current flowing through capacitor C and, as a result, no voltage drop across capacitor C. Accordingly, the voltages at nodes A and B will be equal to one another. Note that since transistors MP5 and MP6 act as source-followers, the drains of transistors MP5 and MP6 will equal one another. Transistors MP5 and MP6 will conduct equal currents and, since the respective drains of transistors MP5 and MP6 are coupled to ground through equal impedances, e.g., resistors $R_4$ and $R_5$, the voltages at output terminals $V_{out,1}$ and $V_{out,2}$ will be equal to one another.

When a differential voltage appears across the inputs to the $G_m$ stage, i.e., across the bases of transistors Q1 and Q2, the differential input voltage $V_2-V_1$ produces a differential output voltage between output terminals $V_{out,1}$ and $V_{out,2}$. For instance, assuming that $V_2$ is higher than $V_1$, transistor Q2 becomes more conductive than transistor Q1 and causes the $G_m$ stage to begin sinking more current from the collector of transistor Q3 than from the collector of transistor Q4. Recalling that the collector current of transistors Q3 and Q4 are equal, pass transistor MP2 will provide more current to node B than pass transistor MP1 provides to node A, thereby causing current flow through capacitor C from node B to node A. The resultant voltage appearing across capacitor C forces the node A voltage to decrease and the node B voltage to increase. The differential nature of integrator 20, by maintaining $V_{C,cm}$ at a constant voltage, ensures that such an increase in the node B voltage is matched by a corresponding and equal decrease in the node A voltage.

The voltage differential between nodes A and B results in transistor MP5 conducting more current than transistor MP6. The current flow through resistor $R_4$ is thus greater than that through resistor $R_5$, thereby resulting in output terminal $V_{out,2}$ being pulled lower than output terminal $V_{out,1}$. This voltage differential across output terminals $V_{out,1}$ and $V_{out,2}$ is indicative of the integral of the differential input voltage, $V_2-V_1$.

Integrator 20 maintains $V_{C,cm}$ at a constant voltage by automatically adjusting the current flow in transistors MP5 and MP6 in response to fluctuations in $V_{C,cm}$. The source voltages of transistors MP5 and MP6, which follow the respective voltages at nodes A and B, remain relatively constant and are averaged at the commonly coupled bases of transistors Q3 and Q4. If $V_{C,cm}$ is too high, transistors Q3 and Q4 will turn off and source less current to nodes A and B, respectively, such that the voltages at nodes A and B will drop. If, on the other hand, $V_{C,cm}$ is too low, transistors MP5 and MP6 become more conductive and, driving the base voltages of transistors Q3 and Q4, pull up nodes A and B. In this manner, transistors MP5 and MP6 provide a common mode negative feedback to prevent $V_{C,cm}$ from rising above and falling below some desired constant value which, as mentioned above, is determined by the current flow through resistors $R_1$ and $R_2$ necessary to turn on and off transistors Q3 and Q4.

Figure 2A:
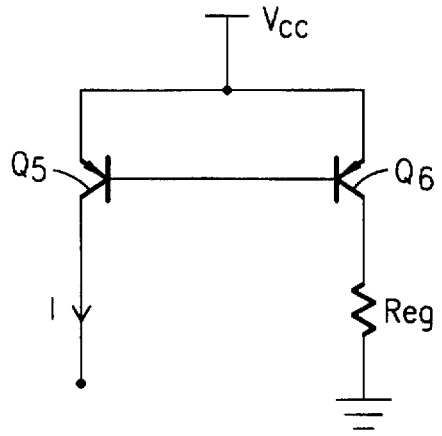
FIG. 2*a* shows a current source which may be used in conjunction with the integrator of FIG. 2.

In other embodiments, resistor R may be replaced by a current source which is referenced from the supply voltage, as shown in FIG. 2a, where transistors Q5 and Q6 are PNP transistors and resistor $R_{eq}$ is of a resistance equal to that of resistors $R_1$ and $R_2$. Such a current source will enable nodes A and B to remain at one-half the supply voltage even during supply voltage fluctuations, thereby optimizing the dynamic voltage range of capacitor C.

In order to achieve an RC time constant sufficiently large such that integrator 20 is properly tuned for low frequency applications, while at the same time minimizing the size of capacitor C so as to allow for capacitor C to be formed on-chip, integrator 20 must exhibit a very large resistance. As will be explained shortly, integrator 20 exhibits a very large internal resistance without requiring a large and expensive conventional resistor.

In accordance with the present invention, integrator 20 realizes such a large resistance, thereby resulting in a large RC time constant, by maintaining the collector voltages of transistors Q3 and Q4 at a substantially constant value. First, pass transistor MP1 acts as a buffer between the collector of transistor Q3 and node A to attenuate voltage fluctuations at node A. For instance, a mV rise in the voltage at node A will result in a significantly smaller rise in the collector voltage of transistor Q3, thereby somewhat isolating the collector voltage of transistor Q3 from node A, thereby greatly reducing voltage fluctuations at the collector of transistor Q3. The collector voltage of transistor Q4 is buffered from node B in a similar manner by pass transistor MP2.

Transistors MP3 and MP4 maintain the somewhat isolated collector voltages transistor Q3 and Q4, respectively, at a substantially constant voltage by adjusting the conductivities of respective pass transistors MP1 and MP2 in response to changes in the respective collector voltages of transistors Q3 and Q4. Consider, for instance, the case where the collector voltage of transistor Q4 is initially at a predetermined value, and that in response to a change in the differential input signal $V_2-V_1$, the voltage at node B increases. This increase in voltage at node B results in an attenuated increase in the collector voltage of transistor Q4 which, in turn, causes transistor MP4 to be less conductive. The gate of pass transistor MP2 will fall toward ground, thereby rendering pass transistor MP2 more conductive. The resultant increased current flow through pass transistor MP2 pulls the collector of transistor Q4 low, thereby quickly returning the collector voltage to its predetermined value. By responding in a manner exactly opposite to that just described when the collector voltage of transistor Q4 dips below its predetermined value, transistor MP4 ensures that the collector voltage of transistor Q4 remains substantially constant regardless of the magnitude of its collector current.

Note that transistor MP3 operates in a manner identical to that of transistor MP4 to maintain the collector voltage of transistor Q3 at a substantially constant voltage regardless of its collector current.

Thus, since the collector voltages of transistors Q3 and Q4 are insensitive to changes in the respective drain voltages of transistors MP1 and MP2, the collectors of transistors Q3 and Q4 are buffered to act as nearly ideal current sources. That is, the drains of transistors MP1 and MP2 exhibit impedances approaching infinite. It follows, then, that the effective impedance across capacitor C, as seen looking in from nodes A and B, approaches infinite. Applicants have found that the above described structure may realize impedances across capacitor C on the order of tera-ohms or higher.

Applicant believes that the only limitation upon the maximum effective impedance across capacitor C is the existence of parasitic leakages within integrator 20. However, as mentioned above, integrator 20 is fully differential and is not responsive to common mode circuit characteristics values. Accordingly, integrator 20 ignores, and is therefore not influenced by, common mode parasitic leakages. In other words, only differential parasitic leakages present in integrator 20 will limit the effective impedance realized across capacitor C.

Such differential parasitic leakages may be minimized by forming capacitor C as a perfectly symmetrical structure of two parallel connected capacitors such that the parasitic leakages on each of its plates, as described earlier and modeled by diodes $D_1$ and $D_2$, are equal to one another. Applicant has found that matching the parasitic leakages of capacitor C and using a fully differential circuit design to cancel the effects thereof, as opposed to attempting to eliminate such parasitic leakages, allows integrator 20 to not only realize a much greater effective impedance across capacitor but also allow for integrator 20 to be operable over a greater temperature range.

The ability to realize large resistances across capacitor on the order of tera-ohms allows integrator 20 to exhibit a time constant sufficiently large for use low frequency applications with capacitor C being on the order of only several pico-Farads. In this manner, capacitor C may be advantageously formed as a small on-chip component. Further, the large effective resistance so realized across capacitor C eliminates the need for forming a large MOS or discrete resistance, thereby resulting in a further savings of die area.

Figure 1:
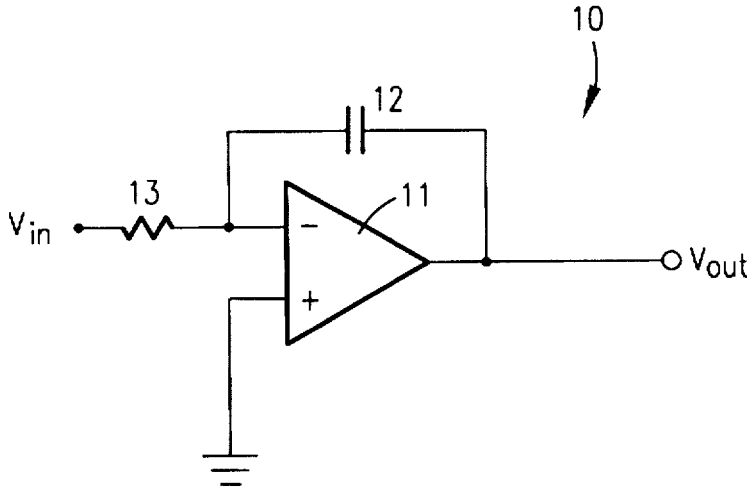
FIG. 1 (PRIOR ART)
FIG. 1 shows a conventional integrator circuit.
Figure 3:
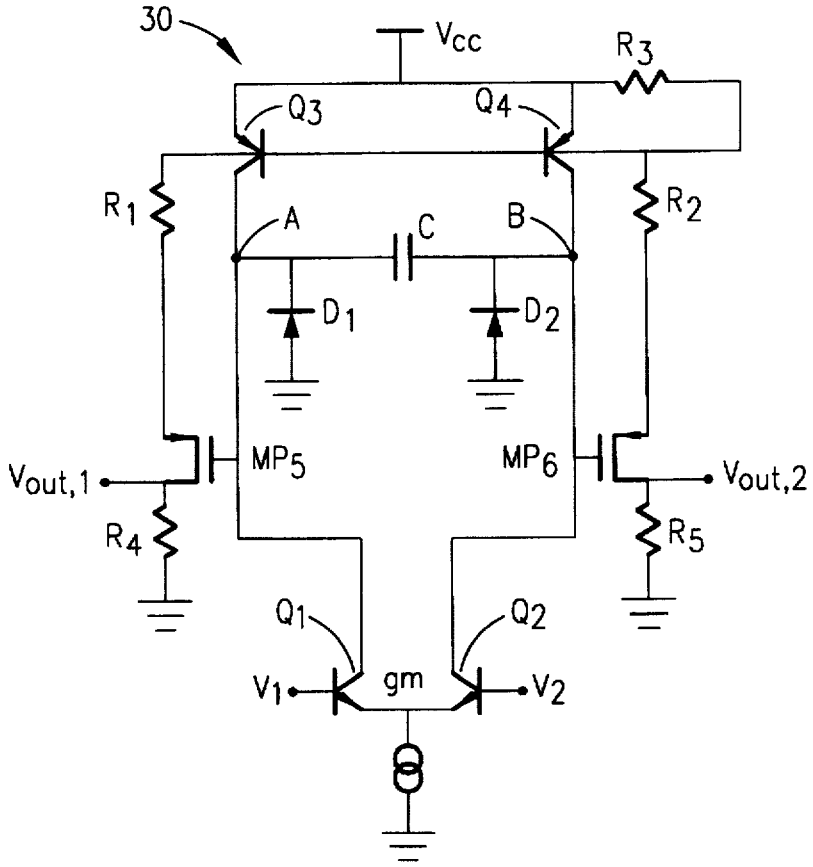
FIG. 3 shows an integrator circuit in accordance with another embodiment in accordance with the present invention.

FIG. 3 shows another embodiment of the present invention. Some features of integrator 30 are identical to those described above with respect to integrator 20 and, accordingly, those components common to both embodiments are similarly labeled.

NPN transistors Q1 and Q2 form the $G_m$ input stage of integrator 30 and are coupled to receive a differential input signal $V_2-V_1$. PNP Transistors Q3 and Q4 are biased so as to source equal currents through their collectors to nodes A and B, respectively. Capacitor C is coupled between nodes A and B and, being identical to capacitor C of integrator 20, is preferably formed by parallel connecting two identical MOS capacitors such that the leakages on either side of capacitor C, as modeled by diodes $D_1$ and $D_2$, are equal. Pull-down resistors $R_4$ and $R_5$ are connected between ground potential and the drains of P-channel MOS transistors MP5 and MP6.

In a manner similar to that of integrator 20 (FIG. 2), integrator 30 (FIG. 3) is fully differential and, therefore, ignores common mode voltages and currents. Also note that integrator 30, like integrator 20, is of a symmetrical design, such that each increase in voltage on one side of integrator 30 is balanced by an equal decrease in voltage on the other side of integrator 30. The common mode voltage of nodes A and B remains constant and, for reasons described above, is denoted as the capacitor common mode voltage, or $V_{C,cm}$.

Integrator 30 operates as follows. In response to the differential input signal $V_2-V_1$, the $G_m$ stage steers current through capacitor C, thereby creating a differential voltage across capacitor C. Thus, where $V_2$ is greater than $V_1$, transistor Q2 will sink more current from transistor Q4 than transistor Q1 sinks from transistor Q3, thereby causing current to flow from node A to node B through capacitor C. Node A rises and node B falls, in equal amounts, and thereby creates a voltage differential across capacitor C. This voltage differential, in turn, creates a voltage differential between output terminals $V_{out,1}$ and $V_{out,2}$ indicative of the integral of the input differential signal $V_2-V_1$.

Transistors MP5 and MP6 balance the operation of integrator 30. Recall that, in response to $V_2$ exceeding $V_1$, node A rises and node B falls. Since the gate of transistor MP6 is thus higher than the gate of transistor MP5, transistor MP5 conducts more of the current sourced by resistor $R_3$ than does transistor MP6. Pull-down resistor $R_4$ pulls node A back down while pull-down resistor $R_5$ allows node B to rise. This action results in nodes A and B being pulled back to $V_{c,cm}$, thereby resulting in a balanced circuit. It is to be noted that all the advantages described above in reference to integrator 20 which stem its fully differential nature are equally applicable to integrator 30.

Unlike integrator 20, integrator 30 does not include circuitry for maintaining the collectors of transistors Q3 and Q4 at a constant voltage and, therefore, cannot realize an effective impedance across capacitor C of the magnitude effected by integrator 20. However, where such large impedances are not required, the simpler design and implementation of integrator 30 may realize savings in die area, cost, and even power consumption.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. An integrator circuit comprising:

first and second input terminals for receiving a differential input current;

a capacitive element having first and second terminals, said capacitive element integrating said differential current to produce a first signal;

a differential amplification circuit having first and second input nodes coupled to said first and second input terminals, respectively, and having first and second output nodes coupled to said first and second terminals of said capacitive element, respectively, wherein said differential amplification circuit provides a high internal impedance by rendering a common mode voltage across said first and second terminals of said capacitive element substantially constant; and first and second output terminals for providing a differential output signal in response to said first signal.

2. The circuit of claim 1 wherein said internal impedance is on the order of tera-ohms.

3. The circuit of claim 1 further comprising:

a differential input stage for receiving an input differential voltage and providing in response thereto, said differential input current to said first and second input terminals.

4. An integrator circuit comprising:

first and second input terminals for receiving a differential input current;

a capacitive element having first and second terminals, said capacitive element integrating said differential current to produce a first signal;

a differential amplification circuit having first and second input nodes coupled to said first and second input terminals, respectively, and having first and second output nodes coupled to said first and second terminals of said capacitive element, respectively, wherein said differential amplification circuit provides a high internal impedance by rendering the voltages at said first and second input terminals insensitive to chances in said differential input current at said first and second input terminals; and first and second output terminals for providing a differential output signal in response to said first signal;

wherein said capacitive element comprises identical MOS capacitors connected in parallel such that the leakages associated with said first terminal of said capacitive element equals the leakages associated with said second terminal of said capacitive element.

5. An integrator circuit comprising:

first and second input terminals for receiving a differential input current;

a capacitive element having first and second terminals, said capacitive element integrating said differential current to produce a first signal;

a differential amplification circuit having first and second input nodes coupled to said first and second input terminals, respectively, and having first and second output nodes coupled to said first and second terminals of said capacitive element, respectively, wherein said differential amplification circuit provides a high internal impedance by rendering the voltages at said first and second input terminals insensitive to chances in said differential input current at said first and second input terminals; and first and second output terminals for providing a differential output signal in response to said first signal;

wherein said differential amplification circuit comprises:

a first transistor having a source coupled to said first input terminal, a drain coupled to said first terminal of said capacitive element, and a gate;

a second transistor having a source coupled to a voltage supply, a drain coupled to said gate of said first transistor, and a gate coupled to said first input terminal;

a third transistor having a source coupled to said second input terminal, a drain coupled to said second terminal of said capacitive element, and a gate; and a fourth transistor having a source coupled to said voltage supply, a drain coupled to said gate of said third transistor, and a gate coupled to said second input terminal.

6. The circuit of claim 5 further comprising:

a fifth transistor having an emitter coupled to said voltage supply, a collector coupled to said first input terminal, and a base; and a sixth transistor having an emitter coupled to said voltage supply, a collector coupled to said second input terminal, and a base coupled to said base of said fifth transistor.

7. The circuit of claim 6 further comprising a resistor coupled between said voltage supply and said base of said sixth transistor.

8. The circuit of claim 6 further comprising:

a seventh transistor having a gate coupled to said first terminal of said capacitive element, a source coupled to said base of said sixth transistor, and a drain coupled to said first output terminal; and an eighth transistor having a gate coupled to said second terminal of said capacitive element, a source coupled to said base of said sixth transistor, and a drain coupled to said second output terminal.

9. The circuit of claim 8 further comprising a first resistor coupled between said source of said seventh transistor and said base of said sixth transistor and a second resistor coupled between said source of said eighth transistor and said base of said sixth transistor.

10. An integrator circuit comprising:

a capacitive element having first and second terminals;

a differential input stage having first and second inputs for receiving a differential input signal and having first and second outputs for charging said capacitive element in response to said differential input signal;

a feedback circuit for maintaining a common mode voltage across said first and second terminals of said capacitive element substantially constant; and first and second output terminals coupled to said first and second terminals of said capacitive element, respectively, said first and second nodes providing a differential output signal.

11. The circuit of claim 10 further comprising:

a first transistor having an emitter coupled to said voltage supply, a collector coupled to said second output of said differential input stage, and a base; and a second transistor having an emitter coupled to said voltage supply, a collector coupled to said first output of said differential input stage, and a base coupled to said base of said first transistor.

12. An integrator circuit comprising:

a capacitive element having first and second terminals;

a differential input stage having first and second inputs for receiving a differential input signal and having first and second outputs for charging said capacitive element in response to said differential input signal; and first and second output terminals coupled to said first and second terminals of said capacitive element, respectively, said first and second nodes providing a differential output signal wherein said capacitive element comprises identical MOS capacitors connected in parallel such that the leakages associated with said first terminal of said capacitive element equals the leakages associated with said first terminal of said capacitive elements.

13. An integrator circuit comprising:

a capacitive element having first and second terminals;

a differential input stage having first and second inputs for receiving a differential input signal and having first and second outputs for charging said capacitive element in response to said differential input signal; and first and second output terminals coupled to said first and second terminals of said capacitive element, respectively, said first and second nodes providing a differential output signal;

a first transistor having an emitter coupled to said voltage supply, a collector coupled to said second output of said differential input stage, and a base;

a second transistor having an emitter coupled to said voltage supply, a collector coupled to said first output of said differential input stage, and a base coupled to said base of said first transistor; and a first resistor coupled between said voltage supply and said respective bases of said first and second transistors.

14. An integrator circuit comprising:

a capacitive element having first and second terminals;

a differential input stage having first and second inputs for receiving a differential input signal and having first and second outputs for charging said capacitive element in response to said differential input signal; and first and second output terminals coupled to said first and second terminals of said capacitive element, respectively, said first and second nodes providing a differential output signal;

a first transistor having an emitter coupled to said voltage supply, a collector coupled to said second output of said differential input stage, and a base;

a second transistor having an emitter coupled to said voltage supply, a collector coupled to said first output of said differential input stage, and a base coupled to said base of said first transistor;

a third transistor having a source coupled to said second output of said differential input stage, a drain coupled to said first terminal of said capacitive element, and a gate;

a fourth transistor having a source coupled to a voltage supply, a drain coupled to said gate of said third transistor, and a gate coupled to said second output of said differential input stage;

a fifth transistor having a source coupled to said second output of said differential input stage, a drain coupled to said second terminal of said capacitive element, and a gate; and a sixth transistor having a source coupled to said voltage supply, a drain coupled to said gate of said fifth transistor, and a gate coupled to said first output of said differential input stage.

15. The circuit of claim 14 further comprising:

a first current source coupled between said gate of said third transistor and ground potential; and a second current source coupled between said gate of said fifth transistor and ground potential.

16. An integrator circuit comprising:

a capacitive element having first and second terminals;

a differential input stage having first and second inputs for receiving a differential input signal and having first and second outputs for charging said capacitive element in response to said differential input signal; and first and second output terminals coupled to said first and second terminals of said capacitive element, respectively, said first and second nodes providing a differential output signal;

a first transistor having an emitter coupled to said voltage supply, a collector coupled to said second output of said differential input stage, and a base;

a second transistor having an emitter coupled to said voltage supply, a collector coupled to said first output of said differential input stage, and a base coupled to said base of said first transistor;

a second resistor having a first end coupled to said respective bases of said first and second transistors and having a second end;

a third resistor having a first end coupled to said respective bases of said first and second transistors and having a second end;

a seventh transistor having a gate coupled to said first terminal of said capacitive element, a drain coupled to said first output terminal, and a source coupled to said second end of said second resistor; and an eighth transistor having a gate coupled to said second terminal of said capacitive element, a drain coupled to said second output terminal, and a source coupled to said second end of said third resistor.

* * * * *